US005437366A

United States Patent [19]

West et al.

[11] Patent Number: 5,437,366

[45] Date of Patent: Aug. 1, 1995

[54] HANDGUN STORAGE CONTAINER FOR EMERGENCY ACCESS

[76] Inventors: Farrin W. West, 2696 N. Oneida La., Provo, Utah 84604; David F. West, 755 W. 300 S., Provo, Utah 84601; Daniel L. West, 210 W. 1200 S. #31, Provo, Utah 84601; Darrin J. West, 340 W. 920 S. #6, Provo, Utah 84601

[21] Appl. No.: 245,430

[22] Filed: May 18, 1994

[51] Int. Cl.[6] ..... B65D 85/00

[52] U.S. Cl. ..... 206/317; 206/524.1

[58] Field of Search ..... 206/317, 3, 1.5, 524.1, 206/524.6

[56] References Cited

U.S. PATENT DOCUMENTS 3,731,818 5/1973 Young ..... 206/317

5,161,396 11/1992 Loeff ..... 206/317 X 5,168,994 12/1992 Beletsky et al. ..... 206/317

5,236,086 8/1993 MacTaggart ..... 206/317

*Primary Examiner*—Jacob K. Ackun

[57] ABSTRACT

A device for opening, in an emergency, a locked handgun storage container without having to use a key or combination or any tool whatsoever. A sheet of tempered glass is installed in one side of the handgun storage container. A trigger device is installed over the corner of the sheet of tempered glass. The sheet of tempered glass is retained by one or more shear supports. When the sheet of tempered glass is struck by a human fist the shear supports break away and the sheet of tempered glass, which is held firmly at one corner, shatters into many small, relatively harmless pieces, thus allowing access to the enclosed handgun.

1 Claim, 1 Drawing Sheet

PLAN VIEW

SHEAR SUPPORT

ELEVATION VIEW

COVER VIEWED FROM INSIDE

TRIGGER MECHANISM

HANDGUN STORAGE CONTAINER FOR EMERGENCY ACCESS

BACKGROUND OF THE INVENTION

This invention relates in general to handgun storage containers that are secured with a locking mechanism and in particular to handgun storage containers that are designed to be opened quickly, in case of an emergency, without having to use a key or a combination or any tool whatsoever.

There are over one hundred million households in the United States that keep handguns for self-defense. Recent surveys have shown that many of these households keep a loaded handgun which is not locked up in a safe place such as a storage container. The reason for this is that in an extreme emergency there may not be time to load the handgun nor find the key to un-lock it.

As a result of all these un-secured handguns thousands of children are killed or injured each year in shooting accidents involving these handguns.

Handgun storage containers that are secured with a keyed locking mechanism typically share a common disadvantage, namely they cannot be opened in an emergency if the key is not readily available. Likewise, handgun storage containers that are secured with a combination locking mechanism may not be opened quickly in case of an emergency because the owner may be panicked and not be able to recall the combination or may misdial the access code. In either case precious time may be lost in trying to open the handgun storage container when under the pressure of a life threatening situation.

There are a few handgun storage containers that incorporate springs and cams in certain ways so as to prevent a small child or adolescent from opening the handgun storage container yet still allow an adult to access the handgun without having to use a key or combination or any tool whatsoever. However, no device is known that incorporates the use of tempered glass to accomplish this objective.

A keyword search of all patents on file as of Mar. 25, 1994 was performed at the Marriot library at the University of Utah. The key words were "FIREARM" and "GLASS" or "GUN" and "GLASS". Two hundred and thirty eight patents were found that included these keywords. The abstract of each of the patents found was reviewed but none referred to a handgun storage container that incorporated a tempered glass panel for the purpose of accessing the handgun storage container by breaking the glass.

A container was constructed and various mounting arrangements of the sheet of tempered glass were tested. It was found that when all four sides of the sheet of tempered glass were supported one could hit the sheet of tempered glass with their bare fist as hard as one could without causing injury to one's fist and the glass did not break. Next the sheet of tempered glass was supported on only the long sides and then only on the short sides, with the same result. The tests were repeated with diminishing amounts of support on either edge until the supports themselves failed and the glass dropped into the container, unbroken. It was evident that for the size, configuration, and materials being used that a way had to be discovered to cause the glass to break when struck with a person's bare fist.

We asked people who were experienced in working with tempered glass if they had any suggestions. They all said that if you hit tempered glass on the edge or on a corner then it would easily break. We did not want to develop a complicated mechanism that would impact an edge or corner nor did we want to have to depend on any sort of tool nor any special instructions as to how to break the glass. (Paramedics are trained to use a special tool to break automobile windows to extract crash victims.)

As we continued our experimentation we took a sheet of tempered glass, gripped one corner with the jaws of a pair of pliers, and quickly rotated the pliers downward. The glass shattered with very little effort! We had found the solution. Namely, all we would have to do is restrain one corner of the sheet of tempered glass and provide sufficient shear supports to produce the desired resistance to breaking and then when the glass rotated inward past the shear supports the corner of the sheet of tempered glass that was restrained would be broken off and the sheet of tempered glass would readily shatter.

SUMMARY OF THE INVENTION

Accordingly, it is the principal object of the present invention to provide a handgun storage container that can be opened in an emergency simply by breaking a sheet of tempered glass that is mounted in the cover of the handgun storage container or in a side of the handgun storage container.

It is also an object of the present invention to mount the sheet of tempered glass in such a way as to withstand all but the heaviest blows from a person's fist so that the glass will remain in place and intact when subjected to moderate force but will disintegrate into small fragments that do not cause serious injury to the person who breaks the glass, thus allowing access without having to use a key or a combination or any tool whatsoever.

These objects are achieved by mounting a sheet of tempered glass in the cover or in one of the sides of the handgun storage container in such a manner that the mounting brackets that keep the sheet of tempered glass in place offer just enough support to resist moderate pressure on the sheet of tempered glass through normal handling. However, once sufficient force is applied to cause the mounting brackets to break away then the trigger device, mounted on at least one corner of the sheet of tempered glass, causes the sheet of tempered glass to immediately disintegrate into small, relatively harmless, fragments thus allowing access to the handgun.

The main advantage of this device is that it allows an adult to break into the handgun storage container, in an emergency, without having to use a key or a combination or any tool whatsoever. This entry can be made in the absolute shortest elapsed time. Further, and equally important, is the fact that a small child cannot likewise break into the handgun storage container because he or she lacks sufficient strength.

The features and advantages of the present invention will become apparent from the following detailed description of the present invention when read with the accompanying drawings.

Figure 1:
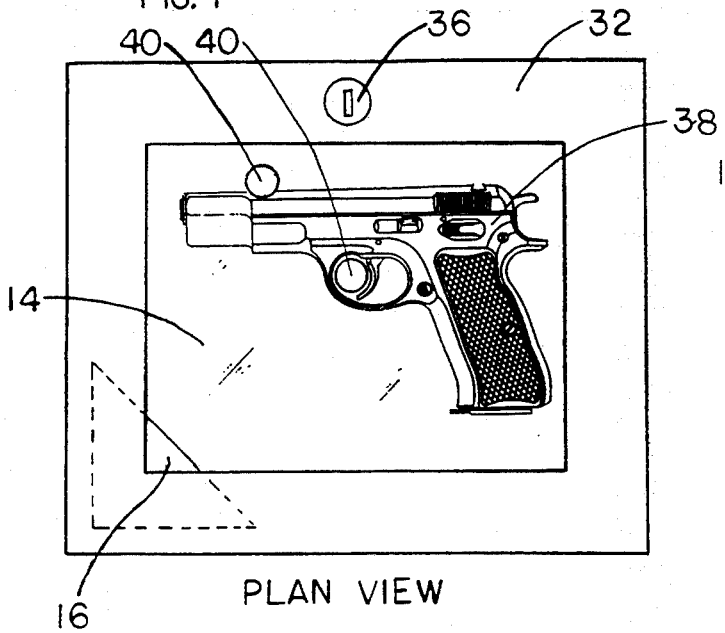
FIG. 1 shows a plan view of the handgun storage container.

| Reference Numerals In Drawings | |
|---|---|
| 12 trigger | 30 base |
| 14 sheet of tempered glass | 32 cover |
| 16 trigger plate | 34 hinge |
| 18 trigger plate fastener | 36 lock |
| 20 shear support | 38 handgun |
| 22 shear support fastener | 40 mounting pin |

FIG. 1 shows a top view of a typical handgun storage container consisting of a housing 30, a fitted lid or access cover 32 and secured with either a keyed lock or a combination lock 36. A handgun 38 is mounted between two posts 40 which are fastened to the back or bottom of the housing (not shown). A sheet of tempered glass 14 is mounted inside the cover 32. A trigger plate 16 is installed directly over one of the corners of the sheet of tempered glass 14.

Figure 2:
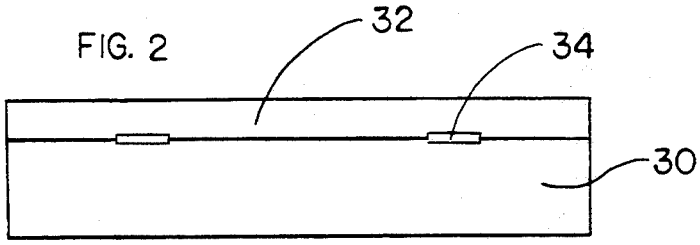
FIG. 2 shows an elevation view of the handgun storage container.

FIG. 2 shows a side view of this same handgun storage container. The cover 32 is connected to the housing 30 with one or more hinges 34. The lock 36 is mounted in the cover 32 and, when locked, engages a strike plate mounted in the housing 30 which locks the cover 32 to the housing 30, or vice versa.

Figure 3:
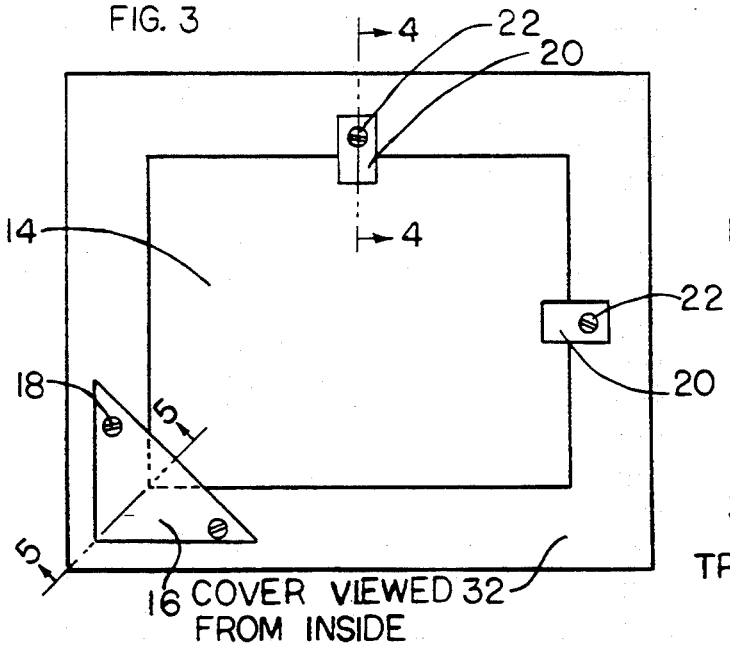
FIG. 3 shows the underside of the cover, as viewed from within the handgun storage container.

FIG. 3 shows the cover 32 as viewed from inside the housing 30. The sheet of tempered glass 14 is mounted inside the cover 32 and is held in place with one or more shear supports 20 that are securely fastened to the underside of the cover 32. The number and placement of the shear supports 20 determine the amount of force required to cause the sheet of tempered glass 14 to move inward, thus engaging the trigger plate 16.

Figure 4:
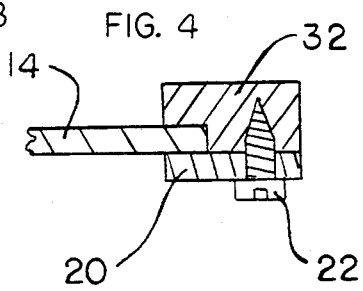
FIG. 4 shows a cross-sectional view of the shear supports.

FIG. 4 is a sectional view showing the installation of a shear support 20. The sheet of tempered glass 14 is placed in the grove in the underside of the cover 32. The shear support 20 is placed over the edge of the sheet of tempered glass 14. The shear support 20 is fastened to the underside of the cover 32 using a shear support retainer 22. The shear support 20 should be in firm contact with the sheet of tempered glass 14 which in turn should be in firm contact with the grove in the underside of the cover 32.

Figure 5:
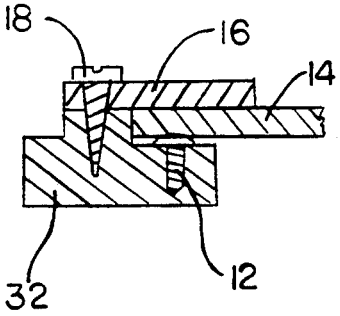
FIG. 5 shows a cross-sectional view of the trigger device.

FIG. 5 is a sectional view showing the trigger plate 16 installed directly over one or more corners of the sheet of tempered glass 14, held in place by one or more trigger plate fasteners 18. The trigger 12, the sheet of tempered glass 14, and the trigger plate 16 should be in firm contact with one another and should be securely attached to the cover 32. If the material that the cover 32 is made of is of sufficient hardness then the trigger 12 may not be required.

DESCRIPTION OF THE PREFERRED EMBODIMENT

The cover 32 in FIG. 1 and the housing 30 in FIG. 2 when assembled as indicated in the description above must provide sufficient strength and rigidity to withstand the desired amount of force required to shatter the sheet of tempered glass 14. Any combination of sizes, shapes, or types of material that meet this requirement will be adequate for the present invention to work.

The cover 32 when assembled onto the housing 30 define the inner chamber of the handgun storage container.

The objects of the present invention are accomplished by mounting the sheet of tempered glass 14 inside the cover 32 as stated in the description above. The sheet of tempered glass 14 will not break until the pre-determined amount of force or impact is applied. At that point the shear supports 20 will fail allowing the sheet of tempered glass 14 to move inward. As the sheet of tempered glass 14 starts to move inward at least one corner is restricted from moving and a breaking of the corner effect is produced which induces a catastrophic failure of the sheet of tempered glass 14 thus allowing access to the enclosed handgun 38.

The combined strength of the trigger plate hold down fasteners 18 must exceed the combined strength of the shear supports 20. The hold down strength of each shear support retainer 22 must exceed the strength of the corresponding shear support 20. The bending resistance of the trigger plate 16 must exceed the combined bending resistance of the cover 32 and the sheet of tempered glass 14.

The tempering of glass is a heat treating and quick chilling process which puts the outer surfaces in compression (over 10,000 pounds per square inch) and the inner surface in tension. As the glass surface must be in tension to break, additional force is required to overcome the surface compression of tempered glass thereby making it 4 to 5 times stronger than regular annealed glass. When broken, tempered glass fractures into thousands of small cube-like particles minimizing the chance of personal injury.

The theory of operation that the present invention is based upon is related to the well known fact, among those persons that work with tempered glass, that even though tempered glass is very much stronger than regular glass of the same thickness it fractures easily when struck directly on the edge or on a corner. Further, when tempered glass breaks it disintegrates into small, relatively harmless fragments thus minimizing possible injury to the person breaking the glass, even if the person uses his or her bare fist, as would possibly be the case if one were to break the glass in an emergency.

The challenge in the present invention was to devise a means whereby this catastrophic behavior could be triggered in a very simple way without having to resort to complicated mechanisms or devices such as spring loaded center punches (such as those used by paramedics to break tempered glass windows in automobiles) or hammer-like tools used to break the glass in fire extinguisher cabinet doors.

It was discovered that if one corner of the sheet of tempered glass is gripped with the Jaws of a pair of pliers and then the pliers are rotated quickly up or down then the glass readily fractures. It is the reverse of this action that is the basic theory behind the present invention. Namely, a corner of the sheet of tempered glass is held stationary between two very rigid (usually metal) surfaces while the sheet of tempered glass is forced to move beyond its shear supports, thus inducing a catastrophic failure of the sheet of tempered glass.

The tempered glass used in the present invention should meet ANSI standard Z 97.1 for safety glazing materials, and the U.S. Consumer Product Safety Commission Standard 16 CFR 1201 Categories I and II. Most sheet glass suppliers can special order this material.

Several thicknesses of glass will work but the preferable thickness should be in the range of one-eighth to three-sixteenths of an inch.

The shear supports should preferrably be made of a plastic material that breaks, not bends, at a fairly predictable impact load.

The trigger and trigger plate should be made of metal, preferrably mild steel.

The handgun storage container should be built of a material that results in an container whose stiffness, when closed and locked exceeds that of the sheet of tempered glass.

Accordingly, the reader will see that the present invention has the following advantages:

1. Young children cannot easily open the handgun storage container.
2. In an emergency an adult can open the handgun storage container, simply by striking the sheet of tempered glass with his or her bare fist. No key or combination or special tool is required.

Although the description above contains many specificities, these should not be construed as limiting the scope of the present invention. For example, the handgun storage container can be of any dimension or shape that is required to enclose the intended handgun or handguns. The shape of the sheet of tempered glass, while preferrably is rectangular, need only permit the extraction of the handgun.

Thus the scope of the present invention should be determined by the appended claims and their legal equivalents, rather than by the example given.

We claim:

1. A handgun storage container, comprising:

a) a housing having an inner chamber sized to contain a a handgun of any of a range of sizes of handguns, one end of said housing containing a first opening for normal access which is closed by an openable access cover held in a closed position thereof by a releasable locking mechanism, thus preventing unauthorized opening thereof;

b) a sheet of tempered glass, of predetermined thickness, rigidly attached to one of said cover and said housing and covering a second opening in said one of said cover and said housing for emergency access which second opening is dimensioned to allow the entrance of an adult human hand to grasp the handgun and remove it from said container;

c) one or more shear support members rigidly attached to said one of said cover and said housing and joined normally to the inner surface of said sheet of tempered glass and along the edges of said sheet of tempered glass at spaced locations around the perimeter of said sheet of tempered glass;

d) a trigger mechanism comprising a means for rigidly restraining at least one segment, of predetermined length, of the perimeter of said sheet of tempered glass from moving away from said housing when said shear supports fail as a result of a predetermined impact being directed normally to the outer surface of said sheet of tempered glass, thus causing said sheet of tempered glass to disintegrate into small fragments said trigger mechanism being attached to said one of said cover and said housing over at least one corner of said sheet of tempered glass;

whereby an adult human can, in an emergency, remove a handgun from a locked container, without first unlocking the container, simply by striking the sheet of tempered glass with his or her fist, causing the shear supports to break away, and allowing the trigger mechanism to cause the sheet of tempered glass to disintegrate into relatively harmless fragments, thus allowing access to the handgun.

* * * * *